US006783439B1

(12) United States Patent
Akagi et al.

(10) Patent No.: US 6,783,439 B1
(45) Date of Patent: Aug. 31, 2004

(54) METHOD FOR MANUFACTURING MIRROR SURFACE TUBE FOR PHOTOSENSITIVE DRUM OF COPYING MACHINE OR THE LIKE

(75) Inventors: Kazuo Akagi, Shimonoseki (JP); Akira Hashimoto, Onoda (JP); Yoshimitu Nakashima, Shimonoseki (JP)

(73) Assignee: Nissin Unyu Kogyo Co., Ltd., Shimonoseki (JP)

( * ) Notice: Subject to any disclaimer, the term of this patent is extended or adjusted under 35 U.S.C. 154(b) by 0 days.

(21) Appl. No.: 09/417,656

(22) Filed: Oct. 14, 1999

(30) Foreign Application Priority Data

Oct. 14, 1998 (JP) ..... 10-292027

(51) Int. Cl.[7] ..... B24B 1/00

(52) U.S. Cl. ..... 451/49; 451/58; 451/54; 451/901; 72/110; 29/895

(58) Field of Search ..... 451/58, 49, 28, 451/901, 51, 41, 36, 37, 39; 92/110; 29/90.01, 895.33, 412, 414; 204/661

(56) References Cited

U.S. PATENT DOCUMENTS 5,080,993 A * 1/1992 Maruta et al. ..... 430/128
5,321,889 A * 6/1994 Watanabe ..... 29/895.3
5,400,630 A * 3/1995 Okumura et al. ..... 29/895.3
5,586,927 A * 12/1996 Herbert ..... 451/88
5,682,581 A * 10/1997 Honma et al. ..... 399/167
5,729,352 A * 3/1998 Shibata et al. ..... 29/895.31
6,105,249 A * 8/2000 Ando et al. ..... 29/895
6,156,187 A * 12/2000 Akagi et al. ..... 205/663

FOREIGN PATENT DOCUMENTS

EP 0 686 888 12/1995
JP 05-337820 12/1993
JP 10-263932 * 10/1998 ..... 451/51

* cited by examiner

*Primary Examiner*—George Nguyen
(74) *Attorney, Agent, or Firm*—Nixon Peabody LLP; David S. Safran

(57) ABSTRACT

A method for manufacturing a mirror surface tube for a photosensitive drum of a copying machine or the like, by which an external surface of an aluminium or aluminium alloy tube can be mirror-processed with high accuracy without surface defects, and in such a way that good quality required for a photosensitive drum is ensured and dimension accuracy, such as roundness, and production yield is improved involves a first step in which an aluminium or aluminium alloy tube, finished in a predetermined shape and dimension with surface roughness of 10 microns or less, is processed by a centerless grinding process. Then, in a second step, a grinding process is performed using an electrolytic integrated polishing apparatus including a tool electrode mechanism having an elastic grindstone so as to make a mirror surface tube having the surface roughness of 2.0 microns or less. Further, preferably, in a third stage, a roller burnishing process is performed to finish the tube to a surface roughness of 0.5 microns or less.

3 Claims, 1 Drawing Sheet

FIG.1
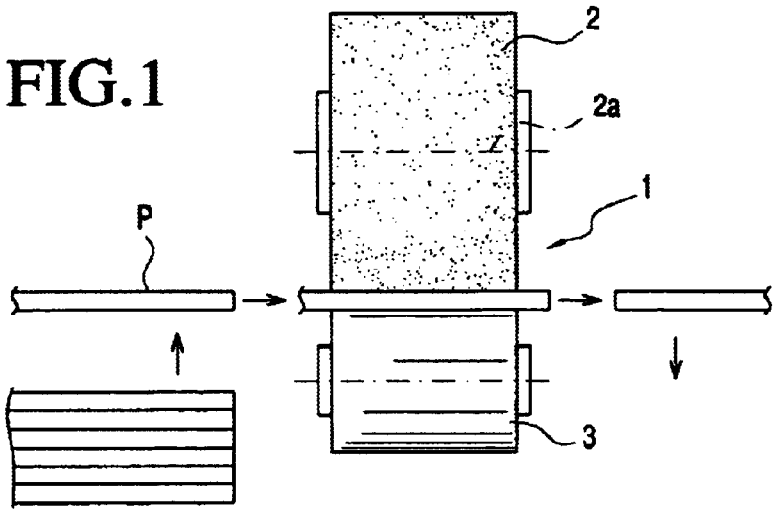
FIG.2
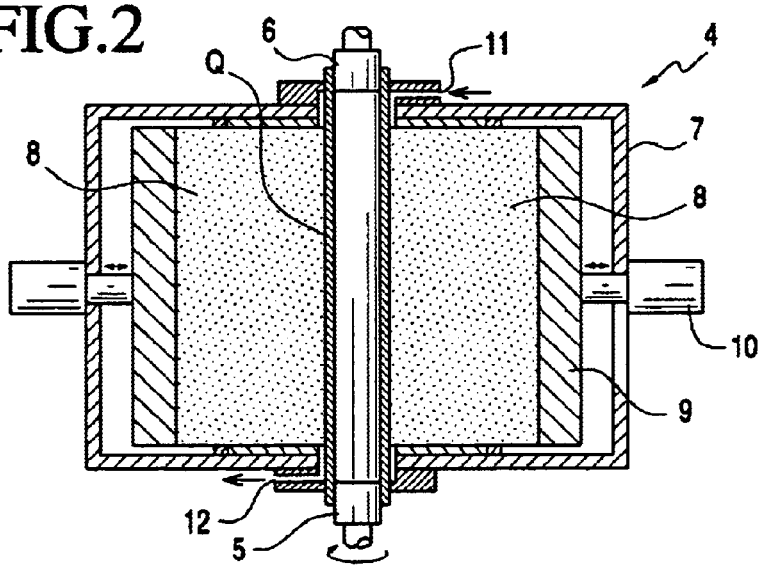
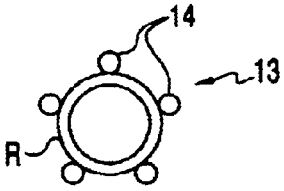
FIG.3A
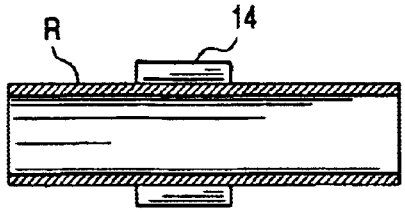
FIG.3B

METHOD FOR MANUFACTURING MIRROR SURFACE TUBE FOR PHOTOSENSITIVE DRUM OF COPYING MACHINE OR THE LIKE

BACKGROUND OF THE INVENTION

1. Field of the Invention

The present invention relates to a method for manufacturing mirror surface tubes for a photosensitive drum of a copying machine or the like.

2. Description of Related Art

Recently, demand for office automation (OA) machines, such as a copying machine, a printer or the like, is increasing for improvement of efficiency of office jobs, and demand for lighter weight and higher quality images for such machines is also increasing. Conventionally, a mirror surface tube made of aluminium or aluminium alloy is used for a photosensitive drum of a copying machine, a printer or the like. The surface of the mirror tube is coated with an organic photosensitive compound (OPC), amorphous silicon (Si), selen (Se) or other material. In this case, the mirror surface tube, that is a substrate of the photosensitive drum is required to have a very small surface roughness, good smoothness and no surface defect such as scratches.

An extrusion or pultrusion aluminium or aluminium alloy tube has a lot of surface defects and unevenness, which should be removed in order to obtain a desired surface roughness by the mirror process, e.g., known as a diamond grinding process, centerless grinding process, burnishing process or electrolytic integrated polishing process.

However, the above-mentioned processes have a lot of problems. The diamond grinding process is expensive, low in productivity and yield drop. This process also easily generates surface defects such as plucking or sticking abrasive grains as well as a bad dimension accuracy such as roundness or bent. Furthermore, the finished mirror surface by this process easily generates an interference band due to reflection characteristics, which may cause a stripe pattern on a printed surface.

The centerless grinding process possibly generates a local scratch due to grind grains dropped from a grindstone. It is difficult to remove this scratch later by a burnishing process.

The burnishing process possibly generates a surface defect involving a crease or plucking when pulling out a raw tube. Therefore, a photosensitive drum using this tube may cause a print defect.

The electrolytic integrated polishing process may generate a lot of surface flaws, such as plucking or sticking, as well as a bad dimensional accuracy, such as roundness or bending since electrodes that perform electrolysis action and grinding material that performs grinding action work independently of each other, and an arrangement of the grinding material is uneven relative to the raw tube. Especially, it is difficult to apply this process to an external surface of an aluminium or aluminium alloy tube.

In the above-mentioned techniques, it is difficult to ensure a quality required for a mirror surface tube used for a photosensitive drum because aluminium material is so soft that surface flaws, such as plucking or sticking, can be generated easily due to grinding material or grinding action.

A mirror surface tube for a photosensitive drum is required to have a finished surface with a high accuracy, which is coated with a thin OPC film, as mentioned above, uniformly for high sensitivity. Furthermore, smoothness of the surface is an important characteristic required for the mirror surface tube, since a minute recess on the surface of the mirror surface tube can be a reservoir of toner, which is required to have micro particles for obtaining a micro dot of high quality image.

SUMMARY OF THE INVENTION

The object of the present invention is to solve the above-mentioned problems of the prior art and to provide a method for manufacturing a mirror surface tube for a photosensitive drum of a copying machine or the like, by which an external surface of an aluminium or aluminium alloy tube can be mirror-processed with high accuracy without surface defects utilising advantages of a centerless grinding process, electrolytic integrated polishing process and burnishing process. The method should ensure good quality required for a photosensitive drum and should improve dimension accuracy such as roundness and yield in production.

In order to attain the above-mentioned object, a method according to the present invention comprises the steps of preparing a long sized aluminium or aluminium alloy tube finished in predetermined shape and dimension with a surface roughness of 10 microns or less, performing a centerless grinding process on the tube, cutting the centerless-ground tube into a predetermined length, and polishing the cut tube by an electrolytic integrated polishing apparatus including a tool electrode mechanism having a special elastic grindstone including a tool electrode mechanism having a special elastic grindstone to obtain an external surface with a surface roughness of 2.0 microns or less.

According to another aspect, the method comprises the steps of preparing a long sized aluminium or aluminium alloy tube finished in predetermined shape and dimension with surface roughness of 10 microns or less, cutting the tube into a predetermined length, performing centerless grinding process of the cut tube, and polishing the centerless-ground tube by an electrolytic integrated polishing apparatus for an external surface of a cylinder including a tool electrode mechanism having a special elastic grindstone so as to finish the surface roughness of 2.0 microns or less.

Preferably, the aluminium or aluminium alloy tube finished by the above-mentioned method into the surface roughness of 2.0 microns or less is further processed by a roller burnishing process using a plurality of burnishing rollers arranged on a circle so as to finish the surface roughness to 0.5 microns or less.

According to still another aspect, the method comprises the steps of preparing an aluminium or aluminium alloy tube having a surface roughness of 10 microns or less, performing a centerless grinding process on the tube, performing electrolytic integrated polishing process of the centerless-ground tube so as to finish the surface to a roughness of 0.5 microns or less, and performing a roller burnishing process on the electrolytic polished tube so as to finish the surface roughness to 0.1 microns or less.

Hereinafter, embodiments of the present invention will be described with reference to the accompanying drawings.

BRIEF DESCRIPTION OF THE DRAWINGS

FIG. 1 is schematic diagram showing a centerless grinding process in a first step of the method according to the present invention.

FIG. 2 is a cross section showing an electrolytic integrated polishing process of a second step.

FIGS. 3A and 3B centerless burnishing process of a third step. FIG. 3A is a side view and FIG. 3B is a cross section.

DETAILED DESCRIPTION OF THE INVENTION

FIG. 1 shows centerless grinding process of a first step. A centerless grinding machine 1 includes a grindstone 2 that is a special elastic grindstone, and a feed roller 3. The grindstone 2 is rotated with a shaft 2*a* thereof at a predetermined speed so that long sized (4–6 meters) raw tubes P are fed sequentially between the grindstone 2 and the feed roller 3 to pass through therebetween while the surface of the raw tubes P is polished.

The raw tubes P are made of aluminium or an aluminium alloy tube finished in a predetermined shape and dimension with surface roughness of 10 microns or less by hot extrusion and drawing.

The centerless grinding process is performed for large flaws on the surface of the raw tubes P and adjusting dimension accuracy, such as roundness.

FIG. 2 shows an electrolytic integrated polishing process of a second step. An electrolytic integrated polishing apparatus 4 includes retaining means, such as chucks 5 and 6 for retaining both ends of the tube to be polished, i.e., the tube Q processed by the centerless grinding process. One of the retaining means 5 or 6 is rotated to rotate the processed tube Q, which is charged with positive electricity by an external electrode (not shown).

Inside a housing 7, plural elastic grindstones 8 are arranged so as to press the surface of the processed tube Q by an appropriate pressure via grind stone holders 9 and cylinders 10. A negative electrode of a tool electrode mechanism (not shown) is disposed adjacent to the elastic grindstone 8. An electrolyte feed port 11 is disposed at one of opening sides of the housing 7, while an electrolyte discharge port 12 is disposed at the other opening side, so that the electrolyte is fed from the electrolyte feed throat 11 while the surface of processed tube 11 is processed by the electrolytic integrated polishing process.

The elastic grindstones 8 are arranged at least at the opposite positions. Adding two more elastic grindstones 8 in the perpendicular direction, in accordance with necessity, four elastic grindstones 8 in total may act on the processed tube Q from four directions. By this electrolytic integrated polishing process, small defects are removed from the surface of the processed tube Q, and the surface roughness thereof may become 2.0 microns or less.

FIGS. 3A and 3B show a roller burnishing process of a third step. A roller burnishing device 13 includes a plurality of (five in the illustrated example) metal rollers 14 arranged along the external surface of a mirror surface tube R, as shown in FIG. 3A. These metal rollers are pressed against the surface of the mirror surface tube R at an appropriate pressure while the mirror surface tube R is rotated or the metal rollers are rotated, and further the mirror surface tube is moved in the axial direction so as to finish the surface. By this roller burnishing process, the surface of the mirror surface tube R is smoothed to a surface roughness of 0.5 microns or less.

An aluminium alloy tube with the surface roughness of 8.25 microns was processed by the centerless grinding machine 1 to the surface roughness of 3.3 microns. Though minute scratches remained on the surface of the tube, the electrolytic integrated polishing apparatus 4 was used for polishing the surface. Using a #220 elastic grindstone, a mirror surface tube with surface roughness of 1.32 microns was obtained, while using a #3,000 elastic grindstone, a surface roughness of 0.34 microns was obtained, both of which were high in accuracy without surface flaws. Further, the mirror surface tube was processed by the roller burnishing device 13 so as to improve the surface roughness to 0.45 microns and 0.08 microns, respectively.

In the above-mentioned embodiment, the centerless grinding process is performed in the first step, the electrolytic integrated polishing process is performed in the second step, and the roller burnishing process is performed in the third step, so as to manufacture mirror surface tubes. However, it is possible to manufacture mirror surface tubes only by the centerless grinding process in the first step and the electrolytic integrated polishing process in the second step, without performing the third step of the roller burnishing process. It depends on the surface roughness required for a tube for a photosensitive drum.

Though the first step of the centerless grinding process is performed on a long sized raw tube P and the centerless-ground tube is cut into a predetermined length in the above explanation, it is also possible that the long sized raw tube P is cut into a predetermined length before performing the centerless grinding process. In this case too, there are two options: one is finished by the second step of the electrolytic integrated polishing process; the other is finished by the third step of roller burnishing process.

The mirror surface tube manufactured in this way is used a substrate of a photosensitive drum. The mirror surface tube is coated with the thin OPC film uniformly to make a photosensitive drum of a copying machine or a printer. Such a mirror surface tube can be used also for a magnet roller or a heat roller.

As mentioned above, according to the method of the present invention, the centerless grinding process and the electrolytic integrated polishing process are combined with each other, and thereto the roller burnishing process is further combined, so that the external surface of the aluminium or aluminium alloy tube is mirror-processed with a high accuracy without surface defects, such as plucking or sticking. The method also ensures a quality required for a mirror surface tube for a photosensitive drum, and can improve dimension accuracy such as roundness and yield in production.

What is claimed is:

1. The method of manufacturing mirror surface tubes for an external surface of a photosensitive drum, comprising the steps of:

preparing a long sized aluminium or aluminium alloy tube finished in a predetermined shape and dimension with a surface roughness of 10 microns or less;

cutting the tube into a predetermined length;

performing a centerless grinding process on the cut tube;

polishing the centerless-ground tube, to form said external surface of the cylinder, with an electrolytic integrated polishing apparatus including a tool electrode mechanism having a special elastic grindstone so as to finish the surface roughness of 2.0 microns or less; and performing a roller burnishing process on the aluminium or aluminium alloy tube having the surface roughness of 2.0 microns or less, using a plurality of burnishing rollers arranged on a circle so as to finish the surface to a roughness of 0.5 microns or less.

2. A method for manufacturing mirror surface tubes for a photosensitive drum, comprising the steps of:

preparing an aluminium or aluminium alloy tube having a surface roughness of 10 microns or less;

performing a centerless grinding process on the tube;

performing an electrolytic integrated polishing process on the centerless-ground tube so as to finish the surface to a roughness of 0.5 microns or less; and performing a roller burnishing process on the electrolytic-polished tube using a plurality of burnishing rollers arranged on a circle so as to finish the surface to a roughness of 0.1 microns or less.

3. A method for manufacturing a mirror surface tube for an external surface of a photosensitive drum, comprising the steps of:

preparing a long sized aluminum or aluminium alloy tube finished in a predetermined shape and dimension with a surface roughness of 10 microns or less;

performing a centerless grinding process of tube;

cutting the centerless-ground tube into a predetermined length; and polishing the cut tube, to form said external surface of the cylinder, by an electrolytic integrated polishing apparatus including a tool electrode mechanism having a special elastic grindstone so as to finish the surface roughness of 2.0 microns or less; and performing a roller burnishing process on the aluminium or aluminium alloy tube having the surface roughness of 2.0 microns or less, using a plurality of burnishing rollers arranged on a circle so as to finish the surface to a roughness of 0.5 microns or less.

* * * * *